US006456804B2

(12) United States Patent
Izawa et al.

(10) Patent No.: US 6,456,804 B2
(45) Date of Patent: Sep. 24, 2002

(54) IMAGE FORMING APPARATUS FOR ENABLING TO SELECTIVELY APPLY A SETTING VOLTAGE OR OTHER VOLTAGES TO A TRANSFERRING MATERIAL

(75) Inventors: Satoru Izawa, Shizuoka-ken; Yuko Tanaka, Yokohama; Norihito Naito, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,933

(22) Filed: Dec. 29, 2000

(30) Foreign Application Priority Data

Jan. 5, 2000 (JP) ..... 2000-000224

(51) Int. Cl.[7] ..... G03G 15/16
(52) U.S. Cl. ..... 399/66
(58) Field of Search ..... 399/66, 45, 81, 399/389; 430/126

(56) References Cited

U.S. PATENT DOCUMENTS 5,450,180 A 9/1995 Ohzeiki et al. ..... 399/50
5,598,256 A * 1/1997 Kimura et al. ..... 399/66 X
5,682,575 A * 10/1997 Komori ..... 399/66
5,732,314 A 3/1998 Tsukida et al. ..... 399/302
5,761,572 A * 6/1998 Watanabe et al. ..... 399/66
5,905,925 A * 5/1999 Kawabata et al. ..... 399/45
5,953,556 A * 9/1999 Yamanaka ..... 399/66
6,058,275 A * 5/2000 Kodama ..... 399/66 X
6,108,500 A 8/2000 Ohkama et al. ..... 399/67

FOREIGN PATENT DOCUMENTS

JP 2-123385 A2 5/1990

* cited by examiner

*Primary Examiner*—Sophia S. Chen
(74) *Attorney, Agent, or Firm*—Fitzpatrick, Cella, Harper & Scinto

(57) ABSTRACT

In the conventional types of Active Transfer Voltage Control (ATVC) system, it is assumed that transferring material has definite impedance. When a toner image is transferred to the transferring material which is in a condition where only the top of the transferring material has high impedance, the conventional ATVC system maintains a transferring current higher than the critical transferring current value with the top of the transferring material and applies a bias voltage at a corrected level, whereby the ATVC system may supply an excessive current to a portion of the photosensitive drum corresponding to a location which is other than the top having the high impedance and at which a toner image is not formed. Therefore, it is provided, an image forming apparatus which is capable of favorably transferring a toner image regardless of impedance of a transferring material.

9 Claims, 7 Drawing Sheets

TIME AFTER THE TOP OF TRANSFERRING MATERIAL IS INSERTED INTO A TRANSFERRING NIP

IMAGE FORMING APPARATUS FOR ENABLING TO SELECTIVELY APPLY A SETTING VOLTAGE OR OTHER VOLTAGES TO A TRANSFERRING MATERIAL

BACKGROUND OF THE INVENTION

1. Field of the Invention

The present invention relates to an image forming apparatus for transferring, to a transferring material such as paper or a plastic sheet, a transferable image formed on a first image bearing body such as an electrophotographic photosensitive body, an electrostatic recording dielectric body or a magnetic recording magnetic body by a known image forming process means such as electrophotography, an electrostatic recording method or a magnetic recording method.

2. Related Background Art

FIG. 7 is a schematic diagram showing an example of transferring apparatus in a conventional image forming apparatus. This transferring apparatus is of a roller transferring type.

Reference numeral 1 denotes a rotating drum type electrophotographic photosensitive body (hereinafter referred to as a photosensitive drum) which is used as a first image bearing body. This photosensitive drum 1 is rotatingly driven in a clockwise direction indicated by an arrow at a predetermined peripheral speed (process speed) and a toner image corresponding to a target image information is formed on an outer circumferential surface of the photosensitive drum 1 as a transferable image (visualized image) by an operation of an electrophotography process appliance (not shown).

Reference numeral 5 denotes an electrically conductive elastic roller (herein after referred to as a transferring roller) which is used as transferring means (contact transferring member). This transferring roller 5 is disposed in parallel with the photosensitive drum 1, pressed to the photosensitive drum 1 at a transferring location under a predetermined pressure so as to form a transferring nip portion N and rotatingly driven in a counterclockwise direction indicated by an arrow which is a forward direction of the photosensitive drum 1 at a predetermined peripheral speed nearly corresponding to the rotating peripheral speed of the photosensitive drum 1.

Reference character P denotes a transferring material which functions as an image bearing body. This transferring body P is fed from a sheet feeding portion (not shown) and conveyed at a predetermined controlled timing to the transferring nip portion N which is a pressure contact portion between the photosensitive drum 1 and the transferring roller 5. In other words, a top of the transferring material P is detected with a sensor 8 and a timing is adjusted so that a toner image forming position on the photosensitive drum 1 is matched with a writing start position on the top of the transferring material P.

The transferring material P which is conveyed at the predetermined timing to the transferring nip portion N is inserted under a predetermined pressure and conveyed in the transferring nip portion N, electric charges having a polarity reverse to that of a toner are imparted to a rear surface of the transferring material P by a function of a bias voltage applied to the transferring roller 5 from a power source 9 by way of a roller core metal and a toner image on the photosensitive drum 1 is transferred to the transferring material P with these electric charges.

After transferring the toner image, excessive electric charges are removed from the rear surface of the transferring material P using an antistatic wire or the like, the transferring material P is sent into a fixing apparatus (not shown) while bearing the transferred toner image and the toner image is fixed permanently on the transferring material P.

After the transferring material P has passed through the transferring nip, a surface of the photosensitive drum 1 is cleaned by wiping off the toner remaining after transferring the toner image using a cleaning apparatus (not shown) and used once again for forming an image.

The applicant of the present invention has already proposed an active transfer voltage control system (hereinafter referred to as ATVC system) which is capable of controlling the bias voltage to the above described transferring roller 5 so that favorable transferring performance can be always obtained regardless of changes in environmental conditions (Japanese Patent Application Laid-Open No. 2-123385).

Specifically, this ATVC system rotates the photosensitive drum 1 prior to an image forming step (preliminary rotation), applies the bias voltage to the transferring roller 5 during the preliminary rotation, measures an output current value at this time with an ammeter 10 and feeds back a measured value to a controller 11. The ATVC system adjusts the bias voltage from the power source 9 with the controller 11 so that the above described output current value is a predetermined value and applies an adjusted voltage or a constant voltage having a value corrected with a coefficient or the like to the transferring roller 5 at a transferring time, thereby making it possible to always obtain a transferring bias voltage having an appropriate constant voltage characteristic regardless of remarkable variations of impedance of the transferring roller 5 independently of the environment.

Since the above described conventional system adjusts a constant bias voltage to be applied to the transferring roller 5 so that the current has the predetermined value in a condition where the photosensitive drum 1 is in direct contact with the transferring roller 5, however, the conventional system has a defect that is causes improper transferring in cases where:

1) The transferring material P has high impedance (for example, in a case where a thick sheet is used or a print is made on a rear surface of the transferring material P which is used once for printing); and 2) The transferring roller 5 has low impedance.

This defect will be described using a figure of voltage-current characteristic curve of the power source for applying the bias voltage to the transferring roller 5 shown in FIG. 8.

In FIG. 8, a curve A represents relationship between a bias voltage V to the transferring roller 5 and an output current I when the photosensitive drum 1 and the transferring roller 5 are rotated in a direct contact condition, and a voltage Va is determined in this case so as to obtain an output current Ia during the preliminary rotation and used as a constant bias voltage to the transferring roller 5 at a transferring step during image formation.

When paper (a transferring material-1) is used as the transferring material P, a V-I characteristic curve is a curve P1 in a condition where the above described transferring material P1 is inserted in a transferring nip portion N between the photosensitive drum 1 and the transferring roller 5, whereby application of the constant bias voltage Va produces a transferring current I1. It may be questioned whether the transferring current I1 is sufficient, but the toner image is transferred favorably in this case since the transferring current I1 is higher than a critical transferring current value It as shown in FIG. 8.

When a transferring material having high impedance, for example, thick paper (a transferring material-2) is used, however, the V-I characteristics is as represented by a curve P2 which is nearer a V axis and the bias voltage Va produces only a transferring current I2 which is lower than It, thereby causing improper transferring.

Furthermore, a curve A' in FIG. 8 represents a V-I characteristic in a case where impedance of the transferring roller 5 is lower than that represented by a curve A, and in this case, a voltage corresponding to the predetermined current value Ia during the preliminary rotation is Va' and a constant bias voltage which is to be applied at the transferring time is Va. In this case, a transferring current for the transferring material-1 is also lower than the critical transferring current value It, thereby causing improper transferring.

When the transferring roller 5 has rather low impedance, the curves P1 and P2 corresponding to the curve A' are actually represented as curves which are slightly farther from the V axis, but these curves are different only slightly from the curves P1 and P2 shown in FIG. 8 and not shown for simplicity of description.

Though it is necessary for maintaining transferring performance to supply electric charges sufficiently to the transferring material P, that is, to maintain the current values I1 and I2 at levels not lower than It, the conventional ATVC system is configured on a premise that the current value Ia during the preliminary rotation is in a definite proportional relation to the current value I1 (or I2) at the transferring time and inevitably causes improper transferring as described above when the impedance of the transferring material P or the transferring roller 5 changes.

In order to solve a problem such as that described above, Japanese Patent Application Laid-Open No. 4-251276 or the like discloses a method for obtaining a transferring apparatus which is configured not to cause improper transfer.

This method is configured to measure an output current from the power source 9 with the ammeter 10 in a condition where the transferring material P is inserted in the transferring nip portion formed by the photosensitive drum 1 and the transferring roller 5 (in a condition where a top of the transferring nip portion in particular), feed back a measured current to a controller 11 and control a bias voltage of the power source 9 so that the above described output current has a predetermined value, thereby preventing improper transferring regardless of the impedance of the transferring material P and the transferring roller 5.

The output current from the power source 9 is measured with the ammeter 10 while the above described transferring material-2 having the high impedance, for example, moves for a distance Le from the top in the moving direction through the transferring nip portion N while being inserted between the photosensitive drum 1 and the transferring drum 5. A measured result is sent to a controller 11 and the current value I2 for the distance Le is obtained. The controller 11 judges that the current value I2 is lower than the critical current value It which causes the improper transferring and enhances the output voltage so as to obtain the current value I1 sufficient for transferring.

FIG. 9A and FIG. 9B show how the output voltage V and the output current I are enhanced dependently on a distance L from the top of the transferring material-2 by the controller 11 which controls the voltage to be applied to the above described transferring roller 5.

In FIGS. 9A and 9B, a predetermined definite value or a voltage value determined by the above described ATVC system is used as the voltage Va which is to be applied at a timing when the top of the above described transferring material-2 in the moving direction is inserted into the transferring nip portion N formed by the photosensitive drum 1 and the transferring roller 5. On the basis of a fact that the current value I2 is lower than the critical transferring current value It in a condition where the transferring material-2 is inserted in the transferring nip portion N for the distance Le from the top, the controller 40 controls the output voltage from the power source 9 so as to obtain the current value I1 capable of preventing the improper transferring, thereby enhancing the voltage to be applied to the transferring roller 5 to Vb after the distance Le from the top of the transferring material. Accordingly, the ATVC system prevents the improper transferring.

However, the above described conventional example is configured on the premise that a toner image is not formed on the top of the above described transferring material P, though the ATVC system corrects the bias voltage so that the transferring current has an appropriate value while the top of the transferring material P is inserted and conveyed through the transferring nip portion N formed between the photosensitive drum 1 and the transferring drum 5. Furthermore, the conventional ATVC system is configured on a premise that the transferring material P has definite impedance. When a toner image is transferred to the transferring material P which is in a condition where only the top of the transferring material P has high impedance, the conventional ATVC system maintains a transferring current higher than the critical transferring current value It with the top of the transferring material and therefore applies a bias voltage at a corrected level, whereby the ATVC system may supply an excessive current to a portion of the photosensitive drum 1 corresponding to a location of the transferring material P which is other than the top having the high impedance and at which a toner image is not formed.

As a result, the excessive current is supplied locally to the photosensitive drum 1 and the photosensitive drum 1 cannot be charged so as to maintain a dark potential till a next charging time, whereby an image formed next may be partially densified or faded (drum memory).

Using FIG. 10, description will be made of a case where the above described phenomenon may occur due to an impedance difference produced by a copying condition of the top of the transferring material.

FIG. 10 is a diagram showing a relationship between a bias voltage applied to the transferring roller 5 and an output current in a condition where the transferring material P is inserted between the photosensitive drum 1 and the transferring roller 5 in the transferring nip portion N and ready for transferring a toner image, and a current I3 is supplied at a transferring voltage V3 in a condition where a transferring material $P_3$ on which a toner image is not to be formed (a blank copy) is inserted in the transferring nip portion.

In case of a black copy for transferring a toner image over an entire surface, on the other hand, a V-I characteristic is different and impedance is enhanced even for the same transferring material $P_3$. As a result, only a current I3' is supplied when the same bias voltage V3 is applied. As a result, the ATVC system which uses only a current detecting system recognizes that the transferring material $P_3$ is a transferring material which apparently has impedance higher than that of a transferring material $P_4$ (for blank copy) which has impedance higher than that of the transferring material $P_3$. $I_4$ is a current value at transferring voltage $V_3$ in the condition that a transferring material $P_4$ without forming a toner image is nipped at the transferring nip.

When a toner image is transferred to a top of a transferring material used for monitoring a transferring current, for example, the ATVC system recognizes that the transferring material $P_3$ as a transferring material having high impedance and sets a bias voltage ($V_3'$) at a rather high level. As a result, an excessive current ($1_3''$)is supplied to a location of the photosensitive drum 1 corresponding to a location of the transferring material which is other than the top and at which copying ratio is low.

The above described conventional example determines transfer control dependently on impedance of the top of the transferring material as described above and has a possibility to select different control voltages dependently on blank copy and black copy on the top of the transferring material.

When a transferring material only a top of which has high impedance or a narrow transferring material which has high impedance is used, in contrast, the ATVC system judges that a current is at a sufficient level upon detecting a current on the top and determines a voltage to be applied accordingly, thereby hardly preventing the improper transferring to a subsequent location of the transferring material or the narrow transferring material which has the high impedance.

As the image forming apparatus has a higher process speed, a transferring material moves for a longer distance while a current value is detected in a condition where a top of the transferring material is inserted in the transferring nip portion N and a copy ratio cannot be ignored for the control system which monitors a current value in the condition where the top of the transferring material is inserted in the transferring nip portion N.

Though a transferring start timing and a current monitoring timing are determined dependently on a signal from the sensor 8 for synchronizing a top of the toner image on the drum with the top of the transferring material, it is necessary to detect more accurately a moment at which a top of the transferring material is inserted into a transferring nip portion in order to determine a transferring voltage by more accurately by monitoring a transferring current in a narrower area of the top of the transferring material inserted in the transferring nip portion N.

Furthermore, a bias voltage V which is actually applied to the transferring material P inserted in the transferring nip portion N and an output voltage Va which is obtained by controlling so as to supply the predetermined current Ia in the condition where photosensitive drum 1 is in direct contact with the transferring roller 5 are usually in relationship of [V>Va].

This is because the drum memory is caused by supplying too high a current in the condition where the photosensitive drum 1 is in direct contact with the transferring roller 5. Therefore, the predetermined voltage V is usually applied at a timing a little later than the moment at which the transferring material is inserted into the transferring nip portion N.

When application of the predetermined bias voltage V to the transferring roller 5 is to be started dependently on a time after detection of the top of the transferring material with the sensor 8 before transferring, however, a high cost and complicated means are necessary for accurately detecting the top of the transferring material. Accordingly, an error of a certain degree is involved by detection of the top of the transferring material and a variation of a certain degree is involved in a time after detection of the top of the transferring material with the sensor 8 till attainment of the transferring material to the transferring nip portion dependently on a kind and a curled condition of the transferring material.

Accordingly, the predetermined voltage V is applied after the transferring material is certainly inserted into the transferring nip portion so that the voltage V which may cause the drum memory will not be applied before the top of the transferring material attains to the transferring nip portion.

In this case, a value of a current which is supplied to the power source 9 in the condition where the top of the transferring material is inserted in the transferring nip portion is monitored for a predetermined time after applying the predetermined voltage V. Accordingly, a time after the transferring material is inserted into the transferring nip portion till the current monitoring is largely variable and a range of the top of the transferring material which is used for the current monitoring is broadened as a process speed is enhanced.

SUMMARY OF THE INVENTION

An object of the present invention is to provide an image forming apparatus which is capable of favorably transferring a toner image regardless of impedance of a transferring material.

Another object of the present invention is to provide an image forming apparatus which is capable of using a definite top portion of a transferring material for current monitoring.

Still another object of the present invention is to provide an image forming apparatus which comprises:

- an image bearing body which bears a toner image;
- a transferring member which forms a nip in cooperation with the above described image bearing body and transfers the toner image on the above described image bearing body to a transferring material;
- detecting means which applies a predetermined voltage to the above described transferring member and detects a supplied current when a top of the transferring material is inserted in the nip;
- setting means which sets a transferring voltage for a location successive to the top on the basis of an output from the above described detecting means; and
- selecting means which selects a transferring voltage to be applied to the transferring material from among the voltage set by the above described setting means and other voltages.

Other objects of the present invention will be apparent from the following description.

DETAILED DESCRIPTION OF THE PREFERRED EMBODIMENTS

Now, embodiments of the present invention will be described with reference to the accompanying drawings.

<First Embodiment> (FIGS. 1 through 4)

(1) Example of Image Forming Apparatus

Figure 1:
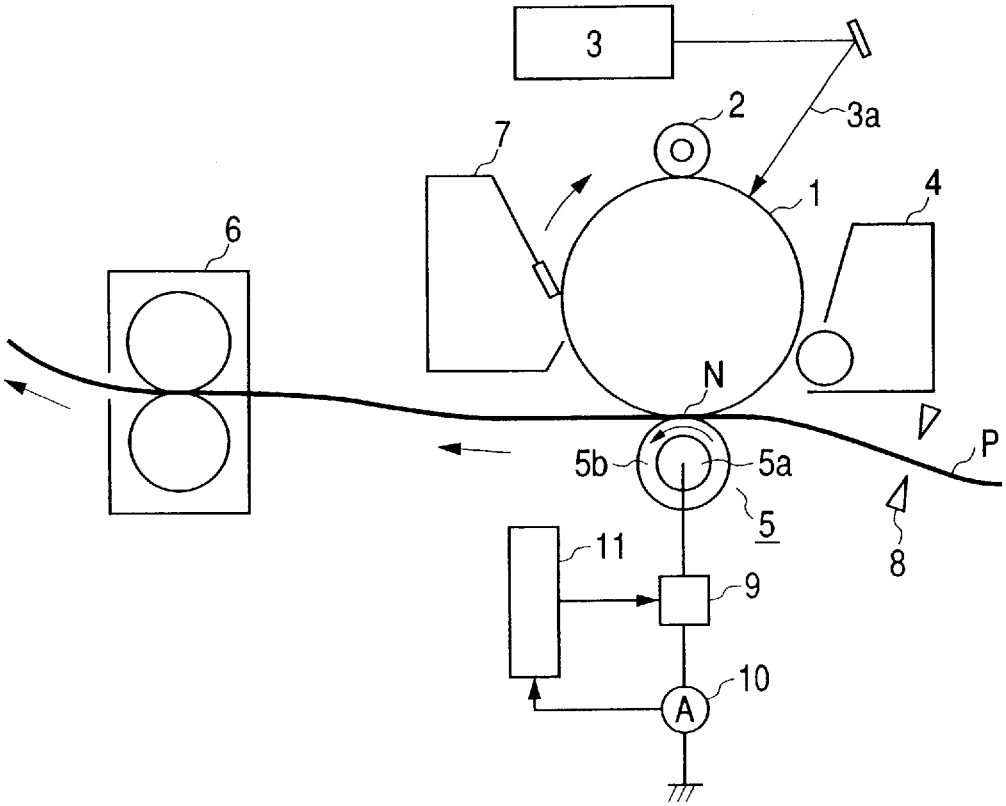
FIG. 1 is a schematic diagram showing a configuration of an example of image forming apparatus.

FIG. 1 is a schematic configurational diagram showing an example of image forming apparatus. The image forming apparatus selected as this example is a roller transfer type laser beam printer which utilizes an electrophotographic process.

Reference numeral 1 denotes a rotating drum type electrophotographic photosensitive body (photosensitive drum) used as an image bearing body which consists of a photosensitive material such as OPC, amorphous Se, amorphous Si disposed on a cylindrical base made of aluminium, nickel or the like.

This photosensitive drum 1 is rotatingly driven in a clockwise direction indicated by an arrow and a surface of the drum is first charged uniformly with a charging roller 2 provided as a charger. Then, an electrostatic latent image is formed by scanning and exposing the surface of the drum 1 with a laser beam 3*a* which is output from a laser scanner 3 and ON/OFF controlled dependently on image information. This electrostatic latent image is developed and visualized with a developing apparatus 4. Used as a developing method is a jumping developing method, a two-component developing method, a FEED developing method or the like, and a combination of image exposure and reversal development is frequently used.

Figure 8:
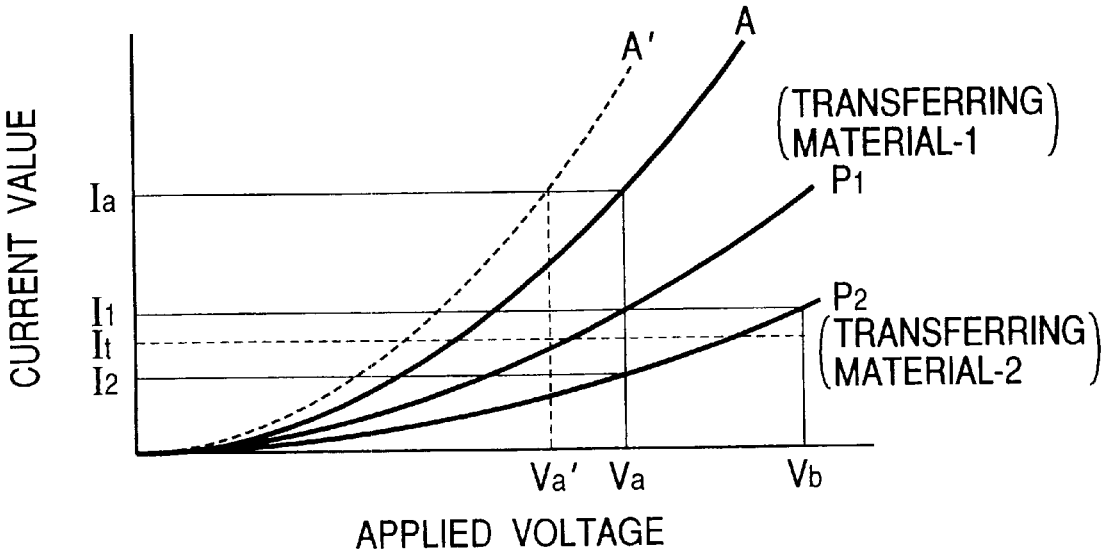
FIG. 8 is a diagram visualizing relationship between a voltage and a current applied for transferring.

A toner image visualized on the photosensitive drum 1 is transferred to a transferring material P which is conveyed as a second image bearing body to a transferring nip portion N at a predetermined timing by a transferring roller 5 functioning as transferring means as in a case of FIG. 8 described above.

Generally used as the transferring roller 5 is an elastic sponge roller or an elastic solid roller composed of an electrically conductive elastic layer 5*b* of electrically conductive sponge which has a resistance adjusted to $1\times10^{6}$ to $1\times10^{10}$ (Ω) with a carbon ion conductive filler or the like and formed over a core metal 5*a* of stainless steel, iron or the like and has hardness of 20 to 70 degrees (ASKER-C/under a load of 1 kg).

A top of the transferring material P is detected with a sensor 8 and a timing is adjusted so that a location of the toner image on the photosensitive drum 1 is matched with a writing start location on a top of a transferring material P. The transferring material P which is conveyed to the transferring nip portion at a predetermined timing is inserted under a definite pressure and conveyed by the photosensitive drum 1 and the transferring roller 5, electric charges having a polarity reverse to that of a toner are imparted to a rear surface of the transferring material P by a function of a bias voltage applied from a power source 9 to the transferring roller 5 and the toner image is transferred from the photosensitive drum 1 to the transferring material P.

The transferring material P to which the toner image is transferred is separated from the surface of the photosensitive drum 1 and conveyed to a fixing apparatus 6 to fix the toner image as a permanent image.

On the other hand, the toner which remains on the photosensitive drum 1 after transferring is removed from the surface of the photosensitive drum 1 with a cleaning apparatus 7. The photosensitive drum 1 whose surface has been cleaned is used repeatedly for forming images.

(2) Transferring Bias Voltage Control System

Figure 2:
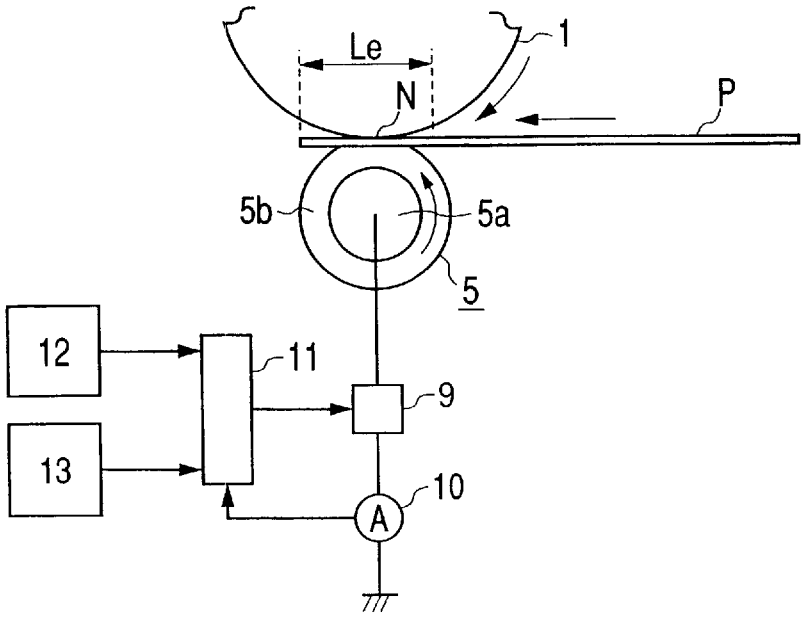
FIG. 2 is a diagram showing a configuration of transferring means.

A transferring bias voltage control system in the above described transferring means will be described with reference to FIG. 2.

A transferring bias voltage is applied from the power source 9 is applied from the power source 9 by way of the core metal 5*a* and the elastic layer 5*b* of the transferring roller, and a value I of an output current from the power source 9 can be detected with an ammeter 10. A detected current value is fed back to a controller 11 so that the bias voltage from the power source 9 can be modified and determined by a controller 11 as occasion demands.

For determining a voltage to be applied, the above described controller 11 uses an algorithm which is described below.

a) Initialization

Prior to an image forming step, the photosensitive drum 1 is preliminarily rotated, a bias voltage is applied from the power source 9 to the transferring roller 5 during this preliminary rotation, a value of an output current is measured with the ammeter 10 at this time and a measured value is fed back to the controller 11.

The controller 11 adjusts the bias voltage from the power source 9 so that the above described current has a predetermined value Ia and a constant voltage Va which has an adjusted value or a value corrected with a coefficient or the like is applied to the transferring roller 5 at a transferring time (ATVC system).

b) Correction Setting

In a condition where the top of the transferring material P is inserted in the transferring nip portion N formed by the photosensitive drum 1 and the transferring roller 5, the bias voltage Va determined by a method described in a) above is applied from the power source 9 to an area Le on the top of the transferring material P, an output current is measured with the ammeter 10 at this time and a measured value is fed back to the controller 11.

Dependently on a value of the current measured with the above described ammeter 10, the control system determines whether or not the bias voltage Va is to be corrected and when the bias voltage is to be corrected, the control system determines a corrected voltage by referring to a predetermined table which lists correction degrees or calculation according to a predetermined calculation formula.

A corrected voltage Va' which is finally determined is applied to areas of the transferring material other than the top Le in the transferring roller 5 at the transferring time.

The embodiment is configured not only to use the above described algorithm for determining the voltage to be applied for transfer but also allow a user to set whether or not correction is made at the top of the transferring material described in b) above. This is because it may be rather better not to make correction in b) above dependently on a kind, a copying pattern, a size and the like of the transferring material and correction cannot be made even when a bias voltage is to be modified.

Figure 10:
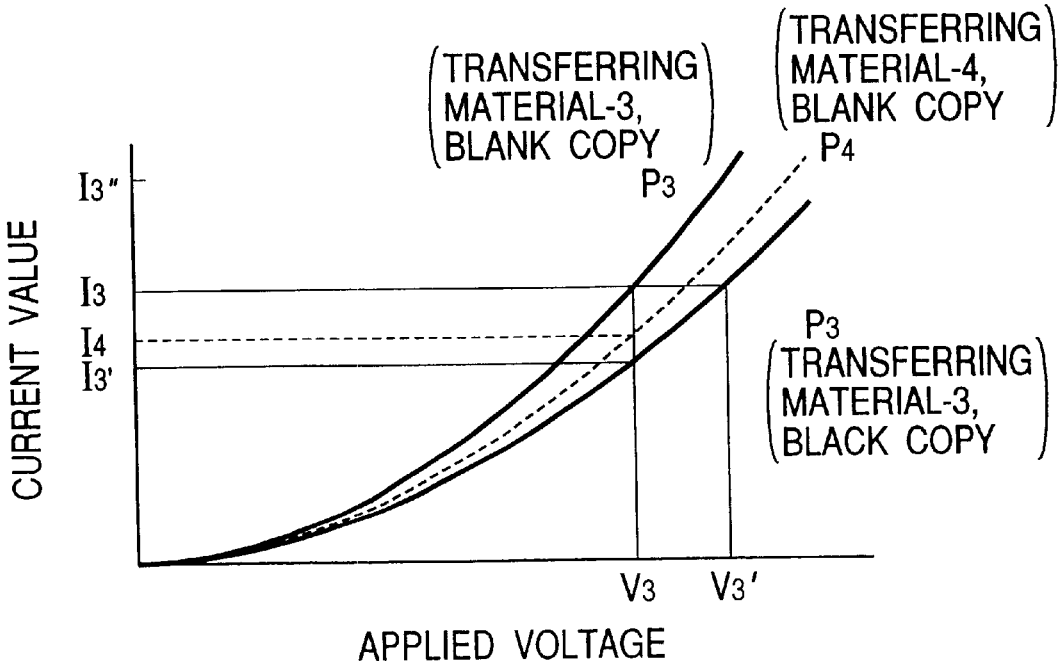
FIG. 10 is a diagram visualizing relationship between a voltage and a current applied for transfer.

Differences in the transferring current dependent on copying patterns on the top of the transferring material have already been described (FIG. 10) and will not be explained here in particular.

Influences dependent on sizes of the transferring material will be described with reference to FIG. 4.

Figure 4:
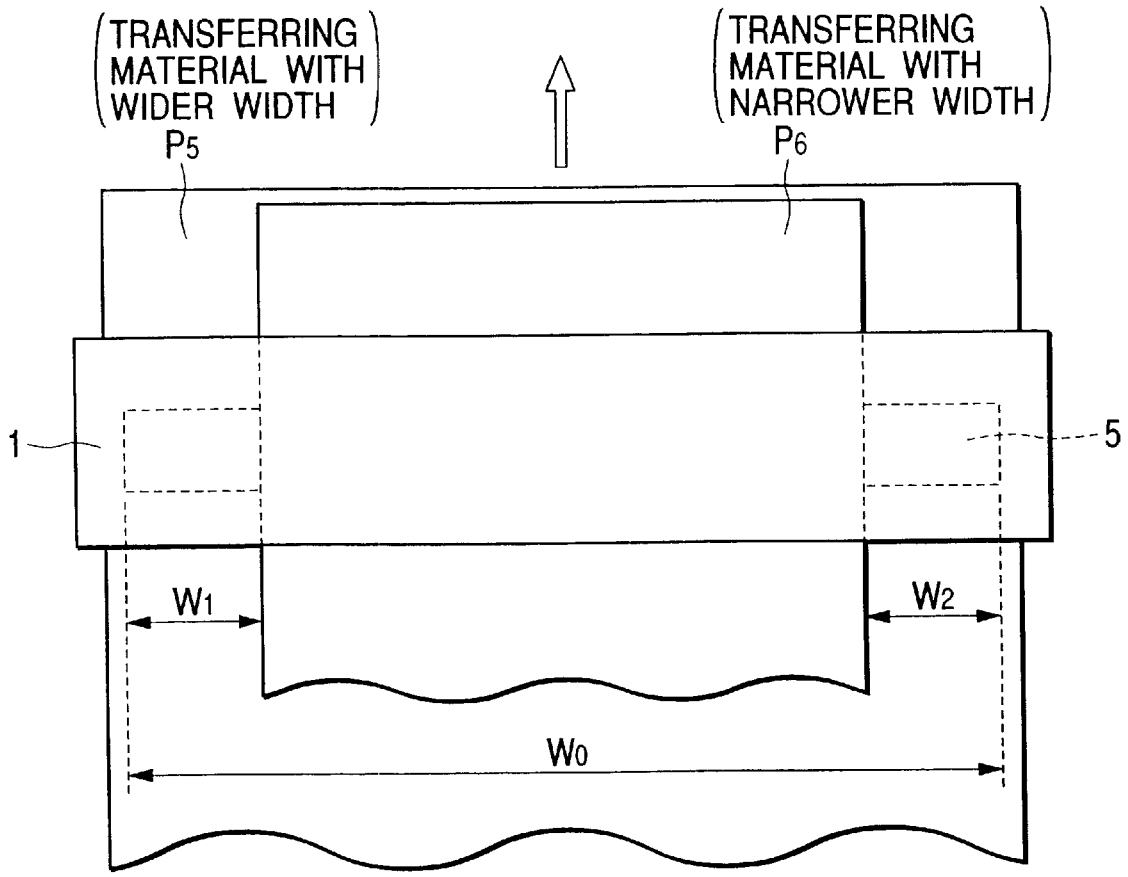
FIG. 4 is a diagram descriptive of influences due to sizes of transferring materials.

In FIG. 4, reference character P5 denotes a transferring material having a width which is equal or a little larger to or than a width W0 of the transferring roller 5.

On the other hand, reference character P6 denotes a transferring material which is narrow enough to allow the photosensitive drum 1 and the transferring roller 5 to be in direct contact with each other at both ends of the transferring material (width W1 and width W2). When the transferring material P6 is conveyed for transfer, a current is liable to be supplied from areas in which the photosensitive drum 1 and the transferring roller 5 are in the direct contact with each other and should the transferring material P6 has impedance higher than that of the transferring material P5, a higher output current is supplied from the power source 9 when the transferring material P6 is conveyed.

As a result, correction may not be set for a transferring material such as the transferring material P6 which originally has high impedance and requires enhancement of a voltage to be applied for supplying a current higher than the critical transferring current value It.

For the reason described above, the embodiment is configured to preliminarily set on an operation panel 12, a host computer 13 or the like whether the algorithm is to be used for correction in b) above so that the user can select a transferring bias voltage which does not cause the defective transfer or the drum memory in case of the above described transferring material or copying pattern.

Figure 3:
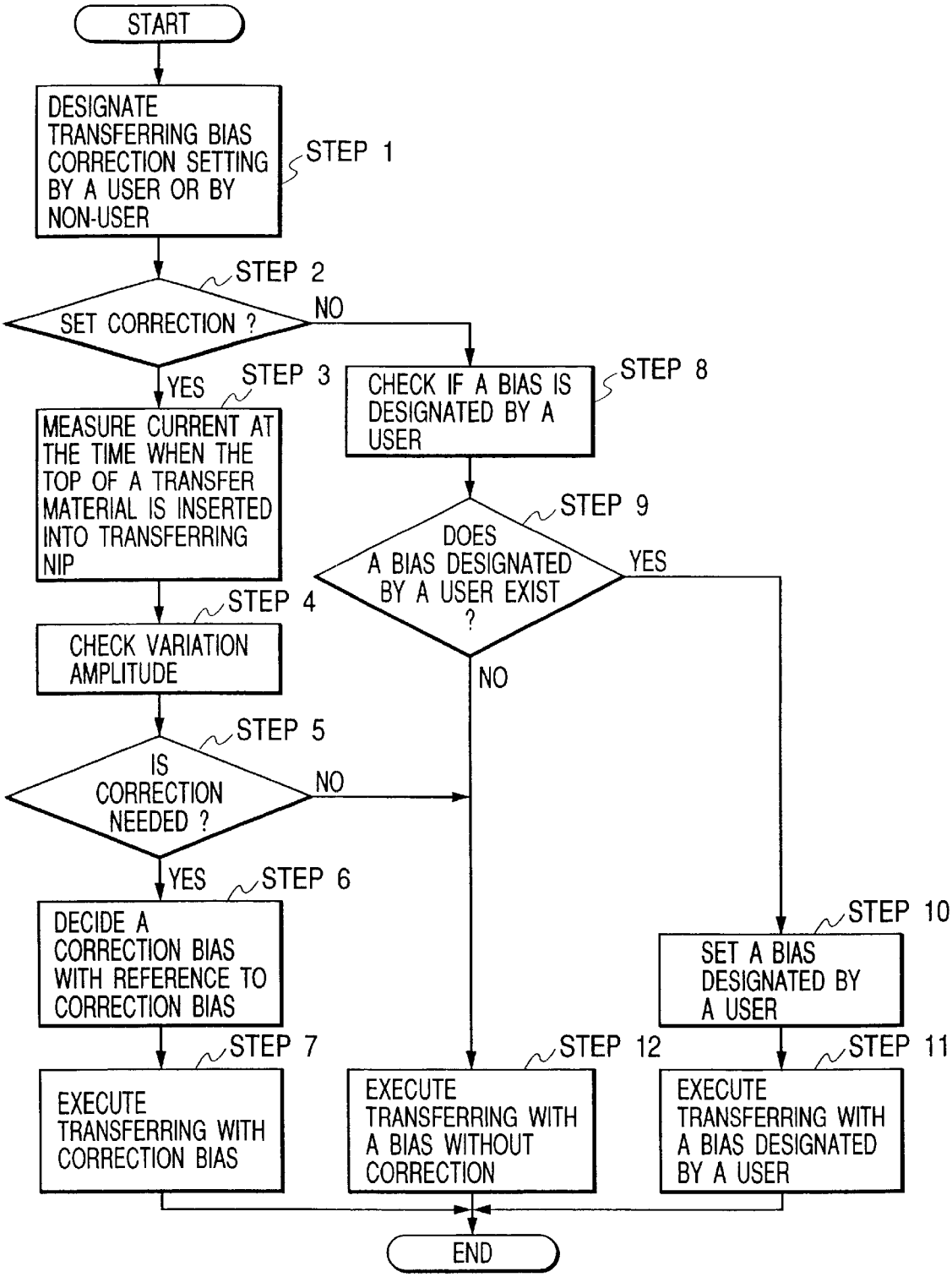
FIG. 3 is a control flowchart according to a first embodiment.

The above described algorithm will be explained with reference to a flowchart shown in FIG. 3. In the flowchart shown in FIG. 3, the user first designates whether the algorithm is to be used for correction setting in b) on an operation panel or the like incorporated with the image forming apparatus (step 1). A default setting may be adopted for use or non-use of the algorithm.

The image forming apparatus first confirms the designation made by the user. When the user designates execution of the correction setting on the transferring material in b) above, the image forming apparatus measures a variation of a current value at a time when the top of the transferring material is inserted into the transferring nip portion N (step 2→3).

The image forming apparatus confirms a variation amplitude of a current or the current value itself and judges whether or not the variation amplitude or the current value is within a range requiring the correction (step 4→5).

When the correction is required, the image forming apparatus determines a degree of correction using the table or according to the predetermined calculation formula (step 6).

When the image forming apparatus judges that the correction is unnecessary, the image forming apparatus adopts a bias voltage which is not corrected.

When the user designates not to execute the correction setting in b), on the other hand, the image forming apparatus confirms whether or not a bias voltage is preliminarily designated by the user (step 2→8).

When a bias voltage is designated by the user, the image forming apparatus sets the designated bias voltage preferentially as a bias voltage to be applied (step 9→10).

When a bias voltage is not designated by the user, the image forming apparatus judges that the bias voltage which is not corrected is designated.

Using the bias voltage which has been determined as a transferring bias voltage to be applied to the transferring roller 5, the image forming apparatus transfers the toner image from the photosensitive drum to the transferring material (step 8, 11 or 12).

The bias voltage designated by the user is a bias voltage which can be set for an image forming apparatus capable of coping with various transferring materials in particular so that the bias voltage is matched with transferring materials usually used by the user. This bias voltage may not be designated in particular or may be designated in a plurality.

Since the embodiment is configured to allow the user to select whether or not the bias voltage is to be corrected dependently on the variation of the current value at a time of insertion of the top of the transferring material into the transferring nip portion N or (step 2), the embodiment makes it possible to transfer toner images from a photosensitive drum to a transferring materials in optimum transferring conditions when only tops of transferring materials have different impedance, when the tops have copying patterns, when toner images are transferred to transferring materials having various sizes and in similar cases.

(3) Examples of Experiments

In order to confirm effects described above, transferring materials having various impedance were prepared and experiments were carried out as described below.

A photosensitive drum 1 composed of an aluminium cylinder which had an outside diameter of 30 mm and was coated with an organic semiconductor was rotated at a peripheral speed of 100 mm/sec and uniformly charged to a bright area potential of −600 V with a charging roller 2. Then, a bright area potential of −150 V was obtained by image exposure 3*a*, a latent image was formed using the image exposure 3*a* as a pattern and then a toner was imparted to a bright area by reversal development with a developing apparatus, thereby obtaining a visualized image (toner image). The toner had a volumetric average particle diameter of 6.5 μm and an average charge amount of 10 μC/g.

A transferring roller 5 was composed of a core metal 5*a* of stainless steel which had an outside diameter of 8 mm and was covered with an elastic layer 5*b* of NBR-based ion conductive rubber. The transferring roller 5 had resistance of approximately $10^8\Omega$, ASKER-C hardness of 60° and an outside diameter of 20 mm. This transferring roller 5 was pressed to the photosensitive drum 1 under a total pressure of 1000 g, thereby forming a transferring nip portion N approximately 1 mm wide.

With a configuration described above, a toner image was transferred to three kinds of transferring materials which had different resistance (transferring material A, transferring material B and transferring material C in order from low to high impedance) and transferred images were evaluated.

Specifically, a top margin of 10 mm was reserved on each transferring material, and the images were evaluated as a case where no copy was obtained within this range (pattern A) and another case where a black copy of the toner image was obtained within a range from 2 mm to 7 mm as measured from the top (pattern B).

As a bias voltage corresponding to Ia=4 μA, Va=1.2 kV was obtained by initialization with the conventional ATVC system. At a timing of insertion of the transferring materials into the transferring nip portion N, applied to the transferring materials was a voltage which was determined by correcting the voltage obtained from the above described ATVC system with a coefficient:

$$Va'=2.0\times Va=2.4\text{ kV}$$

On the basis of variations of a current value caused when tops Le=5 mm of the transferring materials are inserted into the transferring nip portion N, the bias voltage was corrected as the above described correction setting in b) in conditions described below.

In this case, current values were monitored while the top Le=5 mm of the transferring material is inserted in the transferring nip portion N and an average value was calculated to determine a detected current Ie.

Condition 1: A bias voltage to be applied is set at +800 V when Ie<2.6 μA.

Condition 2: A bias voltage to be applied is set at +550 V when 2.6 μA≦Ie<2.8 μA.

Condition 3: A bias voltage to be applied is set at +340 V when 2.8 μA≦Ie<3.0 μA.

Condition 4: A bias voltage to be applied is set at +160 V when 3.0 $\mu$A≦Ie<3.2 $\mu$A.

Condition 5: A bias voltage to be applied is set without correction when 3.2 $\mu$A≦Ie.

Table 1 summarizes correction results obtained by transferring the toner image to each transferring material in the conditions described above and image evaluation results.

"Correction" in Table 1 lists conditions which are used for correction out of the above described conditions 1 through 5.

The images were evaluated for unsatisfactory transferring (unsatisfactory result 1 in the table) and drum memory (memory 1 in the table). The drum memory is a phenomenon that too high a transferring current is supplied locally to the photosensitive drum 1, whereby the transferring material cannot be charged to a dark potential of −600 V by next charging with the charging roller 2 and a next image is made rather dense. In Table 1, a mark "o" indicates an unproblematic level, a mark "Δ" indicates an allowable level and a mark "x" indicates a degraded level.

For comparison, improper transferring (unsatisfactory result 2 in the table) and the drum memory (memory 2 in the table) obtained without the correction are also listed as evaluation results.

TABLE 1

| | Experiment 1 | Experiment 2 | Experiment 3 | Experiment 4 | Experiment 5 | Experiment 6 |
|---|---|---|---|---|---|---|
| Transferring material | A | A | B | B | C | C |
| Top pattern | A | B | A | B | A | B |
| Correction | Condition 5 | Condition 3 | Condition 4 | Condition 2 | Condition 2 | Condition 1 |
| Unsatisfactory result 1 | ○ | ○ | ○ | ○ | ○ | ○ |
| Memory 1 | ○ | x | ○ | Δ | ○ | ○ |
| Unsatisfactory result 2 | ○ | ○ | Δ | Δ | x | x |
| Memory 2 | ○ | ○ | ○ | ○ | ○ | ○ |

From the results summarized in Table 1, it will be understood that the correction setting of the transferring bias voltage made it possible to obtain favorable images free from improper transferring on transferring materials which have high impedance, but in experiment 2 where black copies are made on the tops, the image forming apparatus judged that the transferring materials had high impedance and enhanced the transferring bias voltages, thereby producing remarkable drum memory. It will be understood that rather favorable images were obtained when the correction setting was not carried out.

Though the conditions were set for the above described experiments with a prime object to correct transferring currents on a positive side until a critical transferring current was exceeded when the transferring currents were too low, correction may be to lower a bias voltage when a current value is too large during insertion of a top of a transferring material in a transferring nip portion.

The above described embodiment allows the user to select whether or not the user designates a sequence to modify a bias voltage to be applied for transferring dependently on a value of an output current from the power source 9 for applying a bias voltage in a condition where the top of the transferring material P is inserted in the transferring nip portion N, thereby making it possible to transfer toner images favorably with no image disturbance while coping with broader materials, copy patterns and the like.

Figure 5:
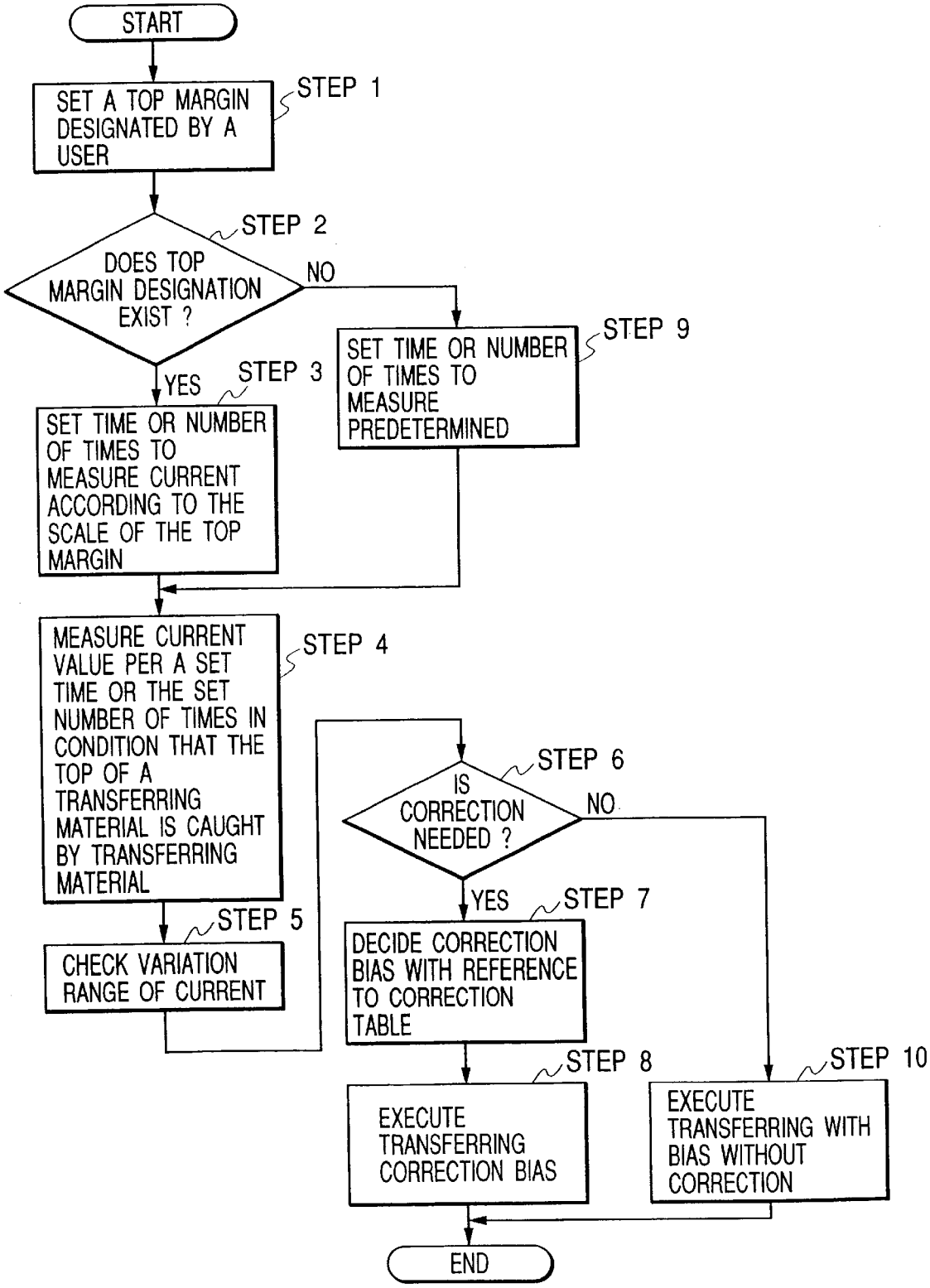
FIG. 5 is a control flowchart according to a second embodiment.

<Second Embodiment> (FIG. 5)

A second embodiment will be described below. In the second embodiment, not only an overall configuration of an image forming apparatus but also a configuration in a condition where a top of a transferring material is inserted into a transferring nip portion N and a current measuring method are identical to those shown in FIG. 2 illustrating the first embodiment and will not be described in particular once again.

In the second embodiment, a time or a number of times to measure currents while the top of the transferring material is inserted in the transferring nip portion N is modified dependently on a size of a marginal portion on the top of the transferring material.

The second embodiment will be described in detail with reference to a flowchart shown in FIG. 5. As already described in the first embodiment, a transferring current is largely influenced by an optical density of a toner image to be formed on the transferring material. Accordingly, the influence due to the toner image can be cancelled by utilizing the marginal portion on the top of the transferring material when a current value is measured in a condition where the top of the transferring material is inserted in the transferring nip portion N, whereby the utilization of the marginal portion makes it possible to more accurately measure the transferring current matched with impedance of the transferring material.

A length of a margin which is designated by a user indicates that a current can be detected while utilizing the margin more effectively.

Accordingly, the user designates a top margin by designating the top margin on an operation panel 12 of the image forming apparatus or by transmitting a length of a margin set on a side of a host computer 13 to the image forming apparatus as shown in FIG. 5 (step 1).

Figure 9A:
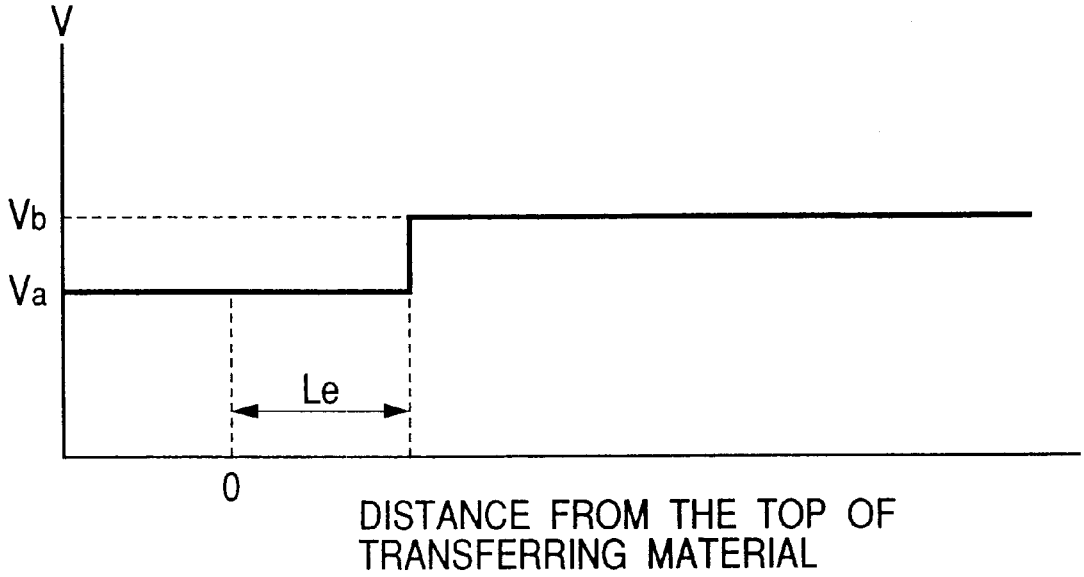
FIGS. 9A and 9B are diagrams visualizing relationship among a distance as measured from a top of a transferring material, a control voltage and a current.
Figure 9B:
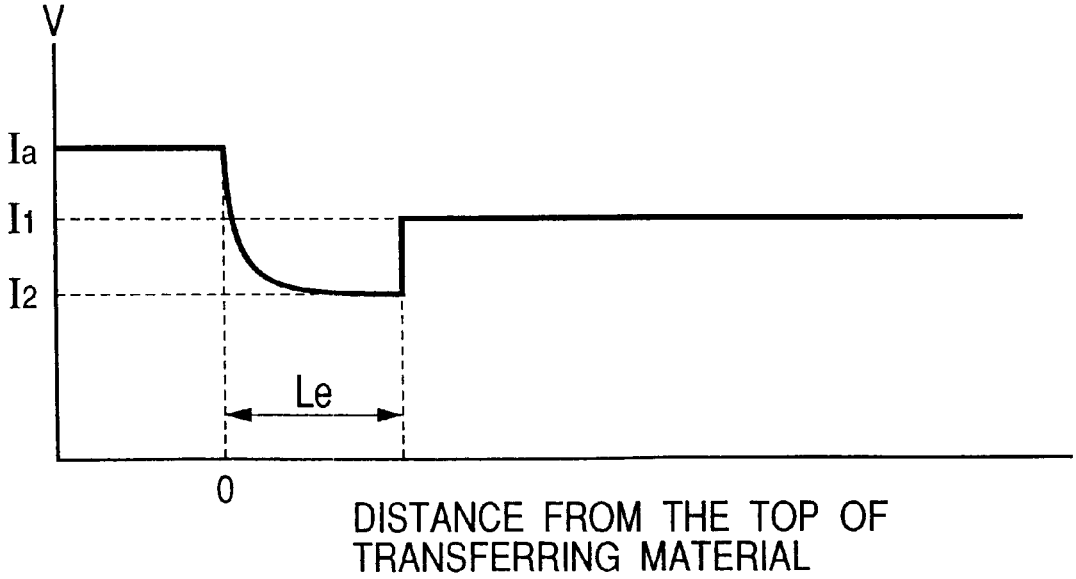

The image forming apparatus judges whether or not a top margin is designated and when a top margin is designated, the image forming apparatus sets, dependently on a size of the top margin, a time or a number of times to measure currents while the top of the transferring material is inserted in the transferring nip portion N (step 2→3). Specifically, the image forming apparatus detects a current value more accurately by prolonging a time or increasing a number of times required for measuring the above described current as the top margin is larger. A current value measured in a condition where the transferring material is conveyed at a certain degree is more stable than a current value measured at an instant the moment that the transferring material P is inserted into the transferring nip portion N in particular. This is because a current value is varied transiently from I1 to I2 as in the above described conventional example shown in FIGS. 9A and 9B the moment that the top of the transferring material is inserted into the transferring nip portion. Accordingly, a current value is detected more accurately in the condition where the top of the transferring material advances at a certain degree since a current value is gradually brought to the current value I2.

When the user does not designate a top margin, on the other hand, the image forming apparatus sets a previously determined current measuring time or number of measuring times using a minimum margin or the like which provides a reliability of a certain degree (step 2→9).

Since the image forming apparatus cannot judge at what location of the top of the transferring material the image is to be formed in such a case, the image forming apparatus may use an algorithm which allows the user to designate no execution of a measurement of a current value when the top of the transferring material exists in the transferring nip portion N as in the above described first embodiment or does not execute the above described sequence to measure the current value unless the user designates a measurement of a current value.

Then, the image forming apparatus measures a current supplied to the transferring roller for a time of a number of measuring times which is set as described above in the condition where the top of the transferring material exists in the transferring nip portion (step 4).

measured for all the above described transferring materials are summarized in Table 2.

Furthermore, a standard deviation (δ) was calculated after repeating 50 measurements for each transferring material and each margin. Smaller values of deviations and a indicate detection of impedance of the transferring materials with higher accuracies.

In this table, the margins are specified in a unit of mm, whereas the deviations and a are specified in a unit of μA.

TABLE 2

| Experiment No. | 1 | 2 | 3 | 4 | 5 | 6 | 7 | 8 | 9 | 10 | 11 | 12 |
|---|---|---|---|---|---|---|---|---|---|---|---|---|
| Transferring material | A | A | A | A | B | B | B | B | C | C | C | C |
| Margin | 3 | 5 | 7 | 9 | 3 | 5 | 7 | 9 | 3 | 5 | 7 | 9 |
| Deviation | 0.4 | 0.3 | 0.2 | 0.1 | 0.6 | 0.4 | 0.2 | 0.1 | 0.9 | 0.6 | 0.3 | 0.1 |
| σ | 0.21 | 0.13 | 0.06 | 0.03 | 0.35 | 0.18 | 0.06 | 0.04 | 0.47 | 0.25 | 0.11 | 0.05 |

Subsequent control steps (steps 5 to 8 and 10) from a variation of the current value are identical to those in the above described first embodiment and will not be described in particular.

The second embodiment which detects a current with an accuracy as high as possible dependently on a size of a top margin of a transferring material can make the correction setting in the above described first embodiment more effective, thereby making it possible to solve problems of the improper transferring, drum memory and the like more effectively.

Using the configuration adopted in the above described first embodiment, it was confirmed at what degree measured results of a transferring current were variable dependently on a length Le of margins contributing to current measurements.

From the three kinds of transferring materials mentioned in the above described first embodiment, average currents Ia, Ib and Ic were detected as a result of measurements of average transferring currents for black copies over entire surfaces.

In contrast, while varying the length Le of each transferring material, current values were measured when the tops Le of the transferring materials were inserted into the transferring nip portion N.

A measurement of the current value was started after 20 msec from a moment that the top of the transferring material is inserted into the transferring nip portion and results obtained by fluxional average (successive average) of current values measured at intervals of 10 msec were adopted as detected current values.

Accordingly, a number of current measurements were different dependently on margins used for the current measurements, and in a case where a margin of the transferring material which is used for the current measurement was 5 mm long, for example, a current measurement was started 20 msec after the top of the transferring material was inserted into the transferring nip portion, or at a location 2 mm after the top, and repeated four times in total at intervals of 10 msec (corresponding to 1 mm) to a location 5 mm after the top, whereafter an average of measured current values was adopted as a detected current value.

Results obtained by calculating differences between detected current values which were measured by the above described method while varying the length used for the current measurements and the average values Ia, Ib and Ic The above results show that the longer the margin for a current measurement of the transferring material, the higher the accuracy of the current measurement and the smaller its variation.

Since a difference is larger for a transferring material which has higher impedance, it will be understood that a margin as long as possible for a current measurement is preferable for correction setting with a transferring material which has high impedance liable to cause improper transferring.

The above described second embodiment which allows the user to designate a length of a top margin for printing makes it possible to detect a current with a higher accuracy by prolonging a current measuring time or increasing a number of current measurements in a condition where a top of a transferring material exists in a transferring nip portion. As a result, the second embodiment allows a transferring bias voltage to be corrected accurately, thereby making it possible to form quality images which are less affected by improper transferring, drum memory and the like.

Figure 6:
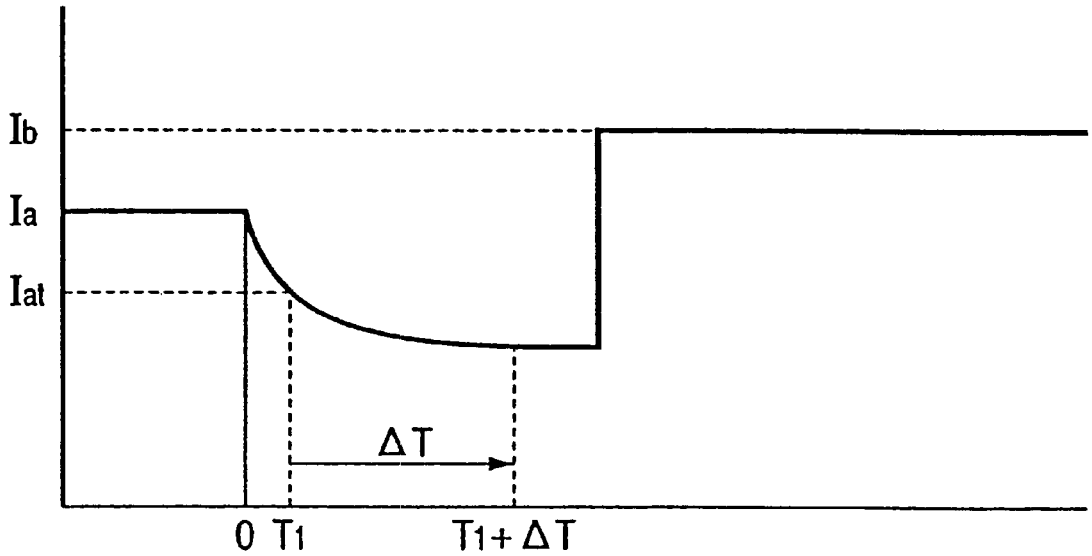
FIG. 6 is a timing chart according to the second embodiment.
Figure 7:
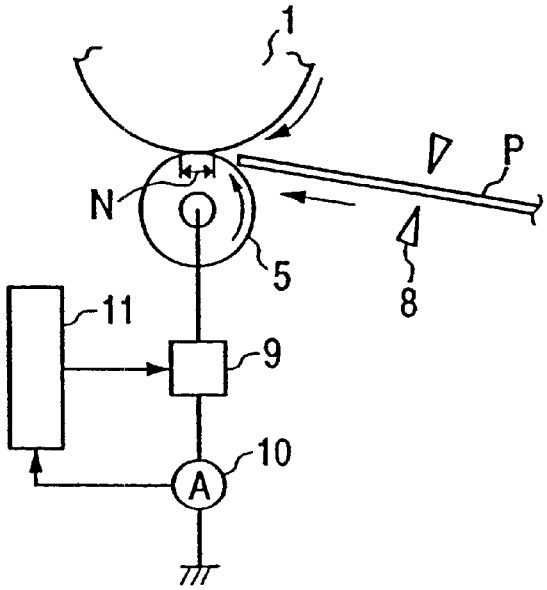
FIG. 7 PRIOR ART
FIG. 7 is a partial diagram of an image forming apparatus as a conventional example.

<Third Embodiment> (FIG. 6)

Now, a third embodiment will be described. Not only an overall configuration of an image forming apparatus which is identical to that of the above described first embodiment shown in FIG. 1 but also a configuration in a condition where a top of a transferring material is inserted in a transferring nip portion and a current measuring method which are identical to those of the second embodiment shown in FIG. 2 will not be described once again in particular.

In the third embodiment, the image forming apparatus detects insertion of the top of the transferring material into the transferring nip portion from a variation of a transferring current causes the moment that the top of the transferring material is inserted into the transferring nip portion and determines a timing to monitor current values taking this moment as standard.

The third embodiment will be described in detail with reference to FIG. 6. In FIG. 6, an abscissa represents a time as measured from the moment that the top of the transferring material is inserted into the transferring nip portion N, whereas an ordinate represents a measured value of an output current from a power source 9 for applying a voltage to a transferring roller 5. Before the top of the transferring material reaches the transferring nip portion N, a voltage Va is applied to the transferring roller 5 to supply a predetermined current Ia which is given by the above described ATVC system. It is desirable that the predetermined current Ia is set at a level at which drum memory is not caused.

When the top of the transferring material is inserted into the transferring nip portion N in this condition, impedance between a core metal 5*a* of the transferring roller and an aluminum cylinder of a photosensitive drum 1 is enhanced by an amount of impedance of the transferring material P, thereby lowering a transferring current. At this time, the image forming apparatus monitors a transferring current value and judges that the transferring material P has reached the transferring nip portion N when the current value does not exceed a predetermined current values Iat (this current value Iat may be variable independently on a control voltage Va at an ATVC time).

Taking a time T1 at this time as a standard time, the image forming apparatus sets a timing to start a current measurement for correction setting as a time ΔT elapsed from the above described standard time T1.

Accordingly, the image forming apparatus detects attainment of the top of the transferring material to the transferring nip portion N by directly measuring a current in the transferring nip portion, thereby being capable of detecting secure attainment of the top of the transferring material to the transferring nip portion N independently of thickness and a curled condition of the transferring material.

The conventional image forming apparatus is configured to detect a top of a transferring material with the sensor 8 installed before the apparatus and then apply a transferring bias voltage after a predetermined time assuming that the transferring material P has attained to the transferring nip portion N, whereby the conventional image forming apparatus applies the transferring bias voltage after a time with a margin has elapsed after the detection of the top of the transferring material with the sensor 8 so that the bias voltage is applied after secure attainment to the transferring nip portion taking into consideration thickness and a curled condition of the transferring material to avoid drum memory and the like. Accordingly, the conventional image forming apparatus is liable to delay a start of the correction setting in the above described first embodiment.

As a process speed is enhanced in particular, delay of the start of the correction setting enhances a possibility to form a toner image on a top of a transferring material which is to be used for the correction setting, whereby a measurement of a transferring current is influenced by presence or absence of a toner image as described in the first embodiment.

The third embodiment detects the transferring material which has attained to the transferring nip portion directly from the transferring current, thereby completely eliminating such a delay as that described above. Accordingly, the third embodiment allows a length of a top of a transferring material which is as short as possible to be used for correction setting for a transferring bias voltage.

Furthermore, a current is liable to be measured with a large error due to a transient variation of a transferring current which is caused the moment that a transferring material is inserted into a transferring nip portion as described in the second embodiment.

The third embodiment is configured to start a current measurement upon lapse of the predetermined time ΔT after detection of attainment of a top of a transferring material to a transferring nip as shown in FIG. 6 and measure a current in an area where a transferring current is more stable, thereby making it possible to measure a current with high accuracy.

Furthermore, the third embodiment is configured to measure current values at least twice for monitoring a current value variation caused when a top of a transferring material attained to a nip portion while a voltage Va is applied at an ATVC time and determine a number of current monitoring times dependently on a degree of the current value variation. The third embodiment makes it possible to execute a sufficient correction setting with a shorter margin by reducing a number of current monitoring when conditions for the correction setting are clear in a case where a current is varied at a high ratio, a case where a current is scarcely varied or a similar case.

When conditions for the correction setting are nearly critical, on the other hand, the third embodiment is capable of enhancing a detection accuracy by increasing a number of current monitoring times.

<Others>

1) In the preset invention, a process to form a toner image on a first image bearing body is not limited to the electrophotographic process which uses the electrophotographic photosensitive body as the first image bearing body, and it is possible to use other processes such as an electrostatic recording process which uses an electrostatic recording dielectric body as the first image bearing body or a magnetic recording process which uses a magnetic recording magnetic body as the first image bearing body so far as the image forming process can form and bear a toner image on the first image bearing body.

2) Furthermore, transferring means is not limited to the transferring roller used in the embodiments and the present invention is, needless to say, applicable to all of corona transferring type, belt transferring type and transferring drum type transferring means.

3) In the present invention, the second image bearing body includes an intermediate transferring material such as an intermediate transferring belt and an intermediate transferring drum.

As described above, the present invention makes it possible for a transferring apparatus of an image forming apparatus to always apply an optimum transferring bias voltage independently of impedance of a transferring material and transferring means, thereby preventing images from being disturbed by improper transferring, drum memory and so on.

While embodiments of the present invention have been described above, the present invention is not limited by these embodiments and is modifiable in any ways within a technical concept of the present invention.

What is claimed is:

1. An image forming apparatus comprising:

an image bearing body for bearing a toner image;

a transferring member for forming a nip with said image bearing body and transferring a toner image on said image bearing body to a transferring material;

detecting means for applying a predetermined voltage to said transferring member and detecting a supplied current when a leading end portion of the transferring material is inserted in the nip;

setting means for setting a transferring voltage to be applied to said transferring member at an area successive to the leading end portion of the transferring material on the basis of an output from said detecting means; and selecting means for selecting a transferring voltage to be applied to said transferring member at the area out of a voltage set by said setting means and other voltages not set by said setting means.

2. The image forming apparatus according to claim 1, wherein said selecting means includes a manual designation switch to designate the other voltages.

3. The image forming apparatus according to claim 2, wherein the other voltages include a user-designated voltage.

4. The image forming apparatus according to claim 1, wherein said selecting means makes selection in accordance with a signal received from a computer.

5. The image forming apparatus according to claim 1, wherein said detecting means detects a current in the leading end portion except an edge of the transferring material.

6. The image forming apparatus according to claim 1, wherein the other voltages are predetermined voltages.

7. An image forming apparatus comprising:

an image bearing body for bearing a toner image;

a transferring member for forming a nip in cooperation with said image bearing body and transferring a toner image on said image bearing body to a transferring material;

detecting means for applying a predetermined voltage to said transferring member and detecting a supplied current when a leading end portion of the transferring material is inserted in the nip;

setting means for setting a transferring voltage to be applied to said transferring member at an area successive to the leading end portion of the transferring material on the basis of an output from said detecting means; and modifying means for modifying a current range within which a current is to be detected by said detecting means.

8. The image forming apparatus according to claim 7, wherein said modifying means comprises a user-operable switch for modifying the current range.

9. The image forming apparatus according to claim 7, wherein said modifying means modifies the range in accordance with a signal received from a computer.

* * * * *

UNITED STATES PATENT AND TRADEMARK OFFICE

CERTIFICATE OF CORRECTION

PATENT NO. : 6,456,804 B2 
DATED : September 24, 2002
INVENTOR(S) : Satoru Izawa et al.

It is certified that error appears in the above-identified patent and that said Letters Patent is hereby corrected as shown below:

Column 2,
Line 58, “material P1” should read -- material-1 --.

Column 3,
Line 1, “is” should read -- are --;
Line 19, “and” should read -- and are --; and
Line 40, “transferring” should read -- transferring material P is inserted in the transferring --.

Column 4,
Line 67, “that” should be deleted.

Column 5,
Line 1, “as” should read -- is --; and
Line 3, “$1_3$” should read -- $I_3$ --.

Column 6,
Line 4, “is” should read -- and is --.

Column 7,
Line 67, “is applied from the power source 9” should be deleted.

Column 9,
Line 1, “has” should read -- have --; and
Line 11, “to” should read -- to be --.

Column 10,
Line 1, “a” should be deleted.

UNITED STATES PATENT AND TRADEMARK OFFICE

CERTIFICATE OF CORRECTION

PATENT NO. : 6,456,804 B2 
DATED : September 24, 2002
INVENTOR(S) : Satoru Izawa et al.

It is certified that error appears in the above-identified patent and that said Letters Patent is hereby corrected as shown below:

Column 14,
Line 5, "a" should read -- σ --;
Line 9, "a" should read -- σ --; and
Line 55, "causes" should read -- that is brought about at --.

Column 15,
Line 12, "values" should read -- value --.

Signed and Sealed this

First Day of April, 2003

JAMES E. ROGAN
*Director of the United States Patent and Trademark Office*